US007261139B2

(12) United States Patent
Varley et al.

(10) Patent No.: US 7,261,139 B2
(45) Date of Patent: Aug. 28, 2007

(54) MANUAL OPERATING MECHANISM FOR UPWARD ACTING DOOR

(75) Inventors: David A. Varley, Lewistown, PA (US); Raymond A. Clark, State College, PA (US); George Lair, Round Hill, VA (US)

(73) Assignee: Overhead Door Corporation, Lewisville, TX (US)

( * ) Notice: Subject to any disclaimer, the term of this patent is extended or adjusted under 35 U.S.C. 154(b) by 343 days.

(21) Appl. No.: 10/926,551

(22) Filed: Aug. 26, 2004

(65) Prior Publication Data

US 2006/0042765 A1 Mar. 2, 2006

(51) Int. Cl.
*E06B 9/56* (2006.01)

(52) U.S. Cl. ..... 160/310

(58) Field of Classification Search ..... 160/310, 160/188, 309, 405, 311, 189, 201; 74/625; 49/497, 199, 200, 276, 364, 273, 274
See application file for complete search history.

(56) References Cited

U.S. PATENT DOCUMENTS

| | | | | | |
|---|---|---|---|---|---|
| 3,089,540 | A * | 5/1963 | Schwartz | 160/98 |
| 3,181,855 | A * | 5/1965 | Willenbring | 49/274 |
| 3,853,167 | A * | 12/1974 | Wardlaw | 160/133 |
| 3,921,264 | A | 11/1975 | Madonian et al. | |
| 3,970,134 | A * | 7/1976 | Sinnock et al. | 160/133 |
| 4,721,146 | A | 1/1988 | Wardlaw | |
| 5,203,392 | A | 4/1993 | Shea | |
| 5,447,477 | A | 9/1995 | Bresson et al. | |
| 5,485,764 | A * | 1/1996 | Sugimoto et al. | 74/535 |
| 5,711,360 | A | 1/1998 | Viotte | |
| 5,921,305 | A * | 7/1999 | Grudl | 160/66 |
| 5,924,949 | A | 7/1999 | Fan | |
| 6,234,453 | B1 * | 5/2001 | Block | 254/285 |
| 6,360,488 | B1 * | 3/2002 | Darling | 49/274 |
| 6,394,172 | B1 * | 5/2002 | Kessous | 160/264 |
| 7,034,682 | B2 * | 4/2006 | Beggs et al. | 340/545.1 |
| 2002/0079068 | A1 | 6/2002 | Kessous | |

* cited by examiner

*Primary Examiner*—Hugh B. Thompson, II
*Assistant Examiner*—Candace L. Bradford
(74) *Attorney, Agent, or Firm*—Gardere Wynne Sewell LLP

(57) ABSTRACT

An upward acting door, such as a flexible curtain rollup door, is moveable between open and closed positions by an electric motor drive unit wherein the motor has a drive shaft with an external drive tang for engagement with a hand crank member. The crank member is adapted for mounting on a wall bracket and in engagement with a switch connected to a motor control unit. When the crank member is removed from its bracket, the switch causes the motor control unit to prevent transmission of electrical power to the motor. A manually disengageable brake is associated with the motor drive unit and is connected via an actuating member to a foot pedal which may be operated by a person using the crank member to disengage the brake and to allow free rotation of the motor drive shaft.

13 Claims, 5 Drawing Sheets

MANUAL OPERATING MECHANISM FOR UPWARD ACTING DOOR

BACKGROUND OF THE INVENTION

Various types of upward acting doors include electric motor driven operators for opening and closing the door. Certain types of upward acting doors, such as flexible curtain rolling doors, are advantageously controlled by operators which include an electric motor drive unit for a rotatable drum on which the flexible curtain is wound and unwound. The motor drive unit typically includes a releaseable electromechanical brake which is engaged when the motor is deengergized to prevent unwanted rotation of the curtain drum.

However, in the event of unwanted loss of electrical power to the motor, it is desirable to be able to manually open or close the door. In this regard, the aforementioned type of motor drive unit includes a drive shaft with an external drive member which may be engaged by a manual tool to rotate the output shaft of the motor drive unit and the aforementioned curtain drum, for example. The type of motor drive unit mentioned herein also, typically, includes a manual brake release lever or mechanism which may be actuated to permit rotation of the motor output shaft.

A problem arises with the use of the aforementioned type of motor drive unit in certain upward acting door applications wherein the motor drive unit is mounted at a substantial elevation above the floor of the building at which the door is mounted, thereby rendering manual operation of the brake release mechanism and the motor drive shaft difficult. The present invention provides a solution to the aforementioned problem which is advantageous and desirable.

SUMMARY OF THE INVENTION

The present invention provides a manual operating mechanism for an upward acting door, particularly a so-called rollup type door, which is normally operated by an electric motor drive unit mounted at an elevation substantially above the floor of a building at which the door is mounted.

In accordance with one aspect of the present invention, an operating mechanism and method is provided for manually operating a rollup curtain type door which is normally driven by an electric motor drive unit mounted adjacent to and drivably connected to a rotatable drum, the drum being mounted generally above and adjacent to an opening in a wall which is covered by the door. The manual operating mechanism includes an elongated crank handle which may be engaged with a drive tang connected to the drive or output shaft of the motor drive unit for manually rotating the output shaft and the aforementioned curtain drum. The crank handle is advantageously mounted on a support bracket which includes a switch electrically connected to a controller for the drive unit and operable such that, when the crank handle is removed from its support bracket, the controller will not supply electrical power to the motor of the drive unit to prevent inadvertent energization of the motor while it is connected to the crank handle.

In accordance with another aspect of the invention, a manual operating mechanism for an upward acting door is provided which includes a manual brake release mechanism for the motor drive unit of a door operator, which release mechanism is preferably mounted in such a way as to be conveniently foot actuated by a person using the crank handle and acting to manually move the door between open and closed positions.

Those skilled in the art will further appreciate the advantages and superior features of the invention upon reading the detailed description which follows in conjunction with the drawings.

DETAILED DESCRIPTION OF A PREFERRED EMBODIMENT

Figure 1:
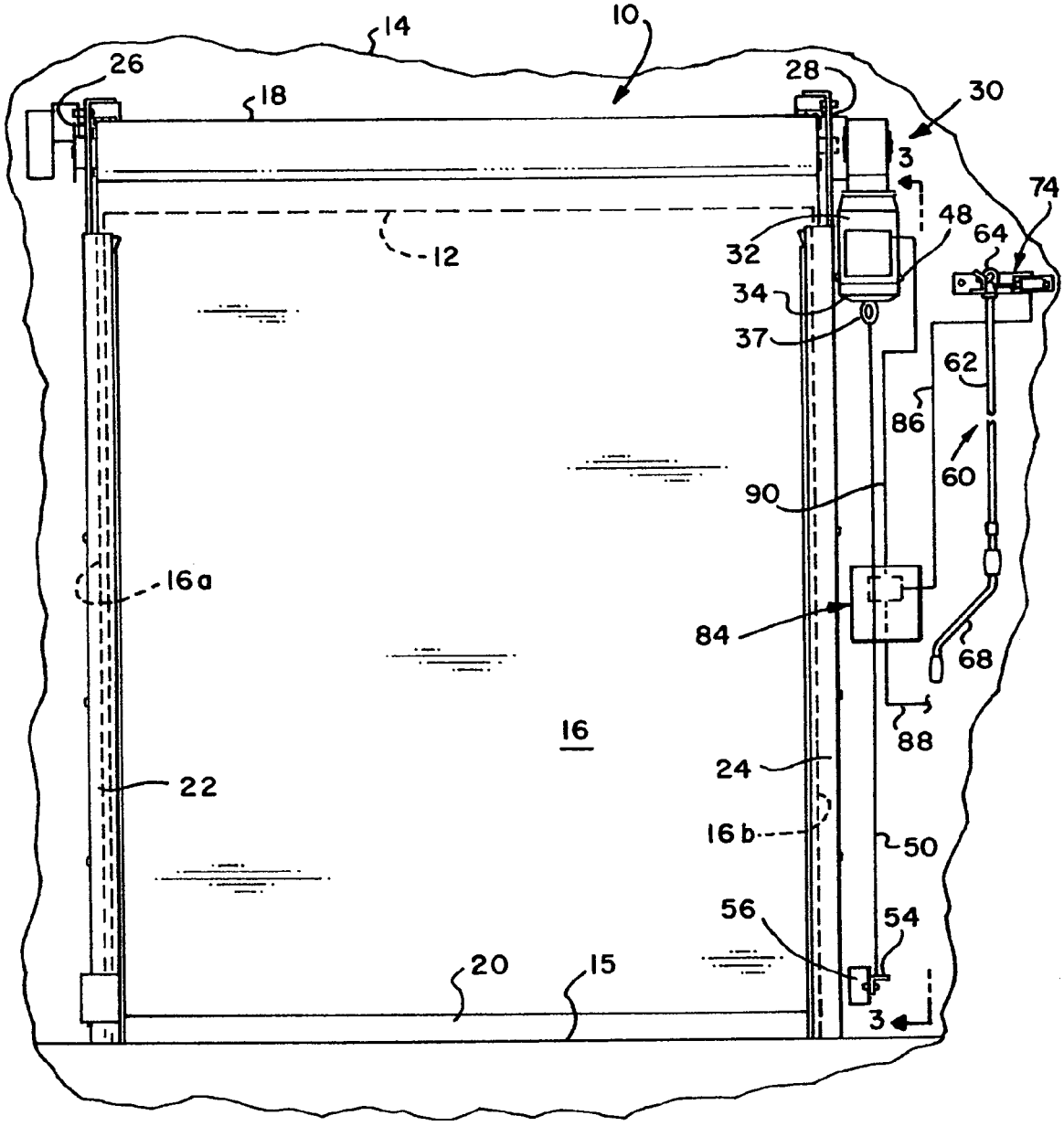
FIG. 1 is front elevation of an upward acting door of the so-called flexible curtain rollup type and including the manual operating mechanism of the present invention.

In the description which follows, like parts are marked throughout the specification and drawing with the same reference numerals, respectively. The drawing figures are not necessarily to scale and certain features may be shown exaggerated in scale or in somewhat generalized or schematic form in the interest of clarity and conciseness.

Referring to FIG. 1, there is illustrated an upward acting door, generally designated by the numeral 10, adapted to close over an opening 12 in a vertical wall 14. The door 10 may be one of several types but, in accordance with a preferred embodiment of the invention, is characterized as a so-called flexible curtain rollup type door. Upward acting door 10 includes a flexible fabric curtain 16 which is connected at one end to a rotatable drum 18 in a known manner and includes a so-called bottom bar member 20 connected to an opposite end of the curtain. The side edges 16*a* and 16*b* of curtain 16 are guided by elongated vertically extending guide tracks 22 and 24, respectively, also in a known manner. Drum 18 is supported for rotation between spaced apart support brackets 26 and 28 which are suitably secured to wall 14. Rotatable drum 18 is also drivenly connected to a door operator motor drive unit, generally designated by the numeral 30, which is also mounted on bracket 28 and driveably connected to drum 18 in a known manner.

Figure 2:
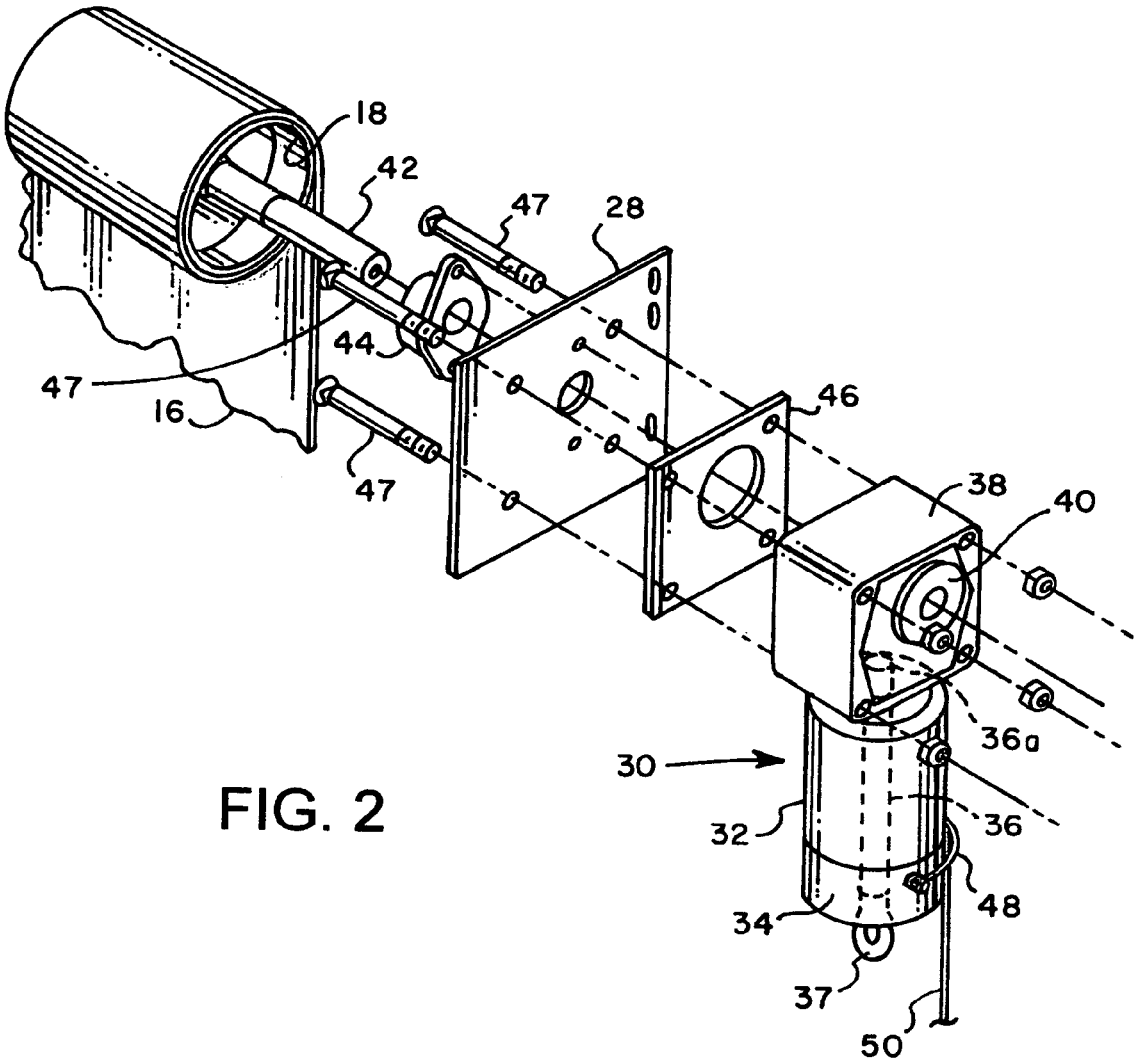
FIG. 2 is a detail exploded perspective view of a portion of the door shown in FIG. 1 and illustrating a preferred arrangement of an electric motor drive unit for the curtain support drum.

Referring briefly to FIG. 2, electric motor drive unit 30 is characterized by an electric motor 32 operably connected to an electromechanical brake unit 34. Motor 32 includes a central rotatable drive or output shaft 36, one end 36*a* of which is driveably connected through a gear reduction drive unit 38 to a drive unit output shaft 40. Shaft 40 is adapted to be driveably connected to a shaft 42 on which drum 18 is supported for rotation therewith. Shaft 42 is operably supported in spaced apart bearing units 44, one shown in FIG. 2, which are adapted to be secured to brackets 26 and 28, respectively. An adaptor plate 46 is illustrated and interposed drive unit 38 and bracket 28. Motor drive unit 30 is operable to be releaseably supported on the bracket 28 by suitable machine bolt and nut assemblies 47.

Figure 3:
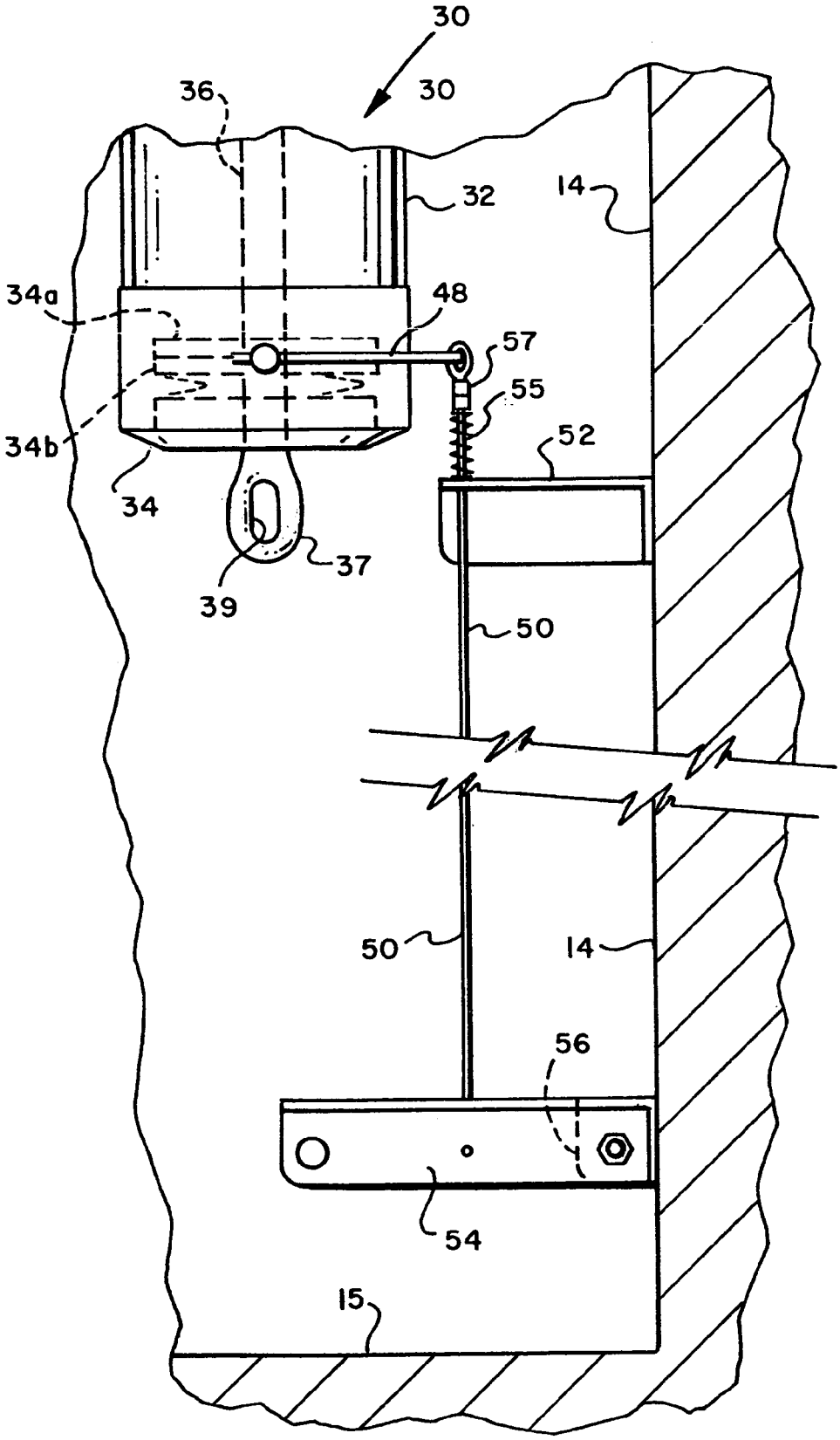
FIG. 3 is a detail view taken generally from the line 3-3 of FIG. 1 and illustrating the manual motor brake release mechanism.

Electric motor drive unit 30 may be of a type commercially available. One source of the motor drive unit 30 is Sumitomo Machinery Corp. of America as their model SM-Hyponic hypoid right angle drive gearmotor. Referring briefly to FIG. 3, the end of motor shaft 36 opposite the end which is connected to gear reduction drive unit 38 is provided with a drive tang 37 having a suitable opening or eye 39 formed therein, see FIG. 3. Electromechanical brake 34 is operable to be energized to release when motor 32 is energized to rotate shaft 36. In the absence of electrical power to the motor 32, brake 34 is normally engaged to prevent rotation of shaft 36. However, brake 34 includes a manual release member including a half circular bail 48 supported for pivotal movement on motor 32 to release brake 34 to allow shaft 36 to be rotated manually, for example. By way of example, brake 34 may include opposed brake disc members 34*a* and 34*b*, FIG. 3, which are normally biased into engagement to prevent rotation of shaft 36. However, in response to movement of bail 48 generally downwardly, viewing FIG. 3, brake disc members 34*a* and 34*b* may be disengaged to allow rotation of the shaft 36. As shown in FIG. 3, bail 48 is connected to an elongated cable 50 trained through a suitable opening in a wall bracket 52 and connected at its lower end to a foot pedal 54. Pedal 54 is mounted for pivotal movement on a bracket 56 which is suitably secured to wall 14 adjacent guide rail 24, see FIG. 1, and only a short distance above floor 15.

Accordingly, in response to the inability to supply electrical power to motor 32, brake 34 may be manually released by depressing foot pedal 54 downwardly, viewing FIG. 3, to actuate brake release bail 48. A coil spring 55 is interposed a connector 57 and bracket 52 to assist in returning bail 48 to its non-actuated position which will result in engagement of brake 34. Connector 57 is connected to cable 50 at the end opposite the end which is connected to foot pedal 54. Accordingly, upon release of foot pedal 54, brake release bail 48 is returned to a position which results in engagement of the brake members 34*a* and 34*b* to prevent rotation of shaft 36. However, when foot pedal 54 is actuated to the position shown in FIG. 5, bail 48 is operable to release the brake 34 to allow rotation of shaft 36.

Figure 4:
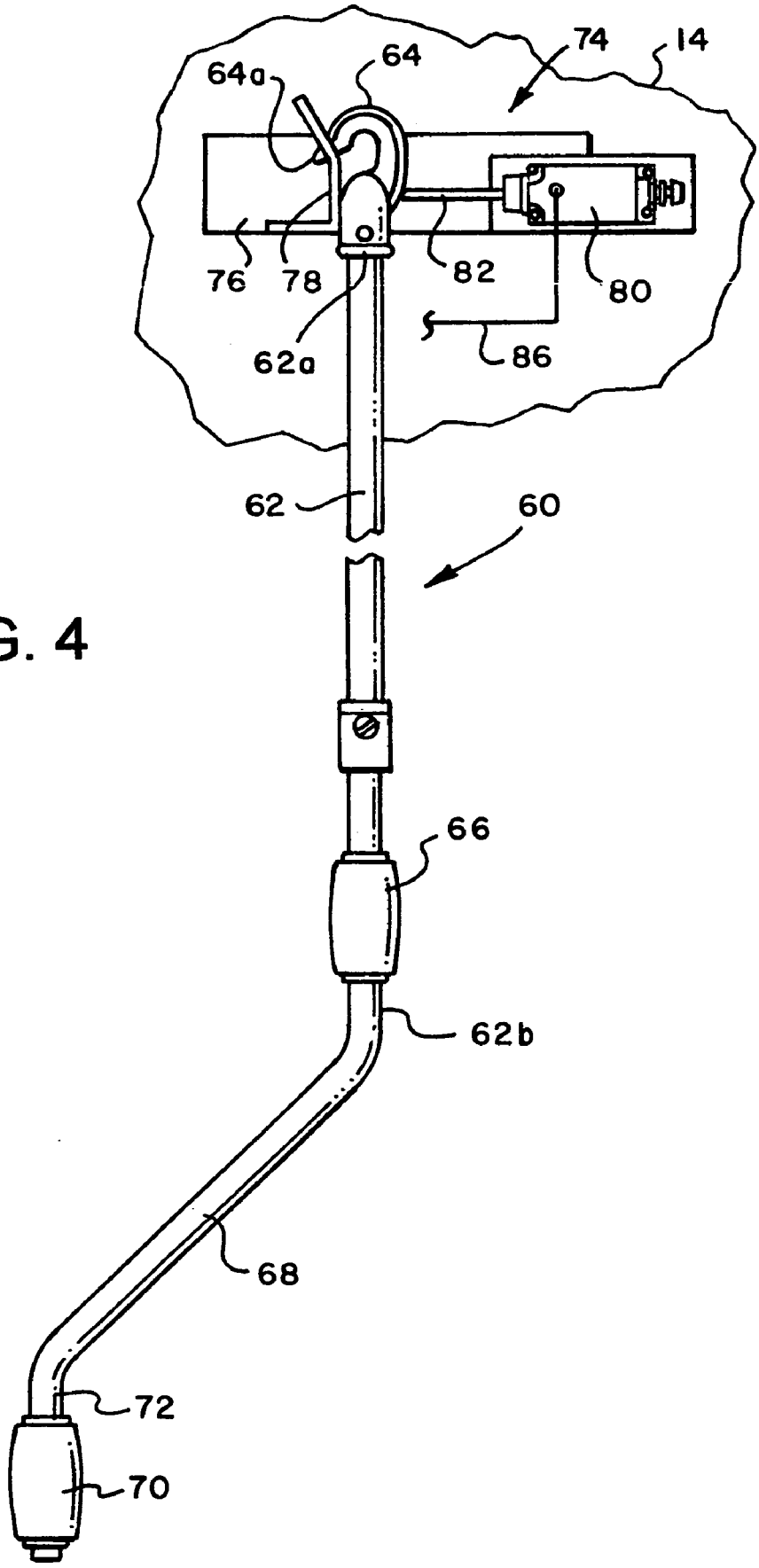
FIG. 4 is a detail elevation view showing the manual crank handle disposed on its support bracket.

Referring again to FIG. 1 and also FIG. 4, the location of motor drive unit 30 in many upward acting door applications is substantially above floor 15, out of reach of door operating personnel. In this regard, the manual door operating mechanism of the present invention is provided with a manual door operating member comprising a crank handle member 60 including an elongated shank 62 having a hook member 64 connected to its distal end 62*a*, FIG. 4. The opposite end 62*b* of shank 62 supports a tubular hand grip 66 which is rotatable relative to the shank 62. Shank 62 is formed integral with an axially offset crank end part 68 having a second tubular hand grip 70 mounted thereon and rotatable relative to a distal end part 72 of crank end part 68.

As shown primarily in FIG. 4, crank handle 60 is adapted to be stored on a support bracket 74 mountable on wall 14, preferably adjacent to the door 10, see FIG. 1. Referring further to FIG. 4, support bracket 74 includes a base 76 suitably secured to the wall 14 and a hook support part 78 projecting normal to the base 76 and adapted to engage the hook 64 of the crank handle member 60 in supportive relationship. Bracket 74 also supports a switch 80 including a spring biased whisker type actuator member 82 engageable with the hook 64 when the hook is mounted on the support bracket 74, as illustrated in FIG. 4. Switch 80 is operably connected to a control unit 84, FIG. 1, by way of suitable conductor means 86. Control unit 84, FIG. 1, is operable to be connected to a source of electrical power via a conductor 88 and for controlling operation of the motor drive unit 30 via conductor means 90 interconnecting the control unit 84 and the motor 32. A suitable control circuit, not shown, is operable in response to removal of hook 64 from the support bracket 74 to respond to actuation of the switch 80 to prevent electrical power from being supplied to motor 32 regardless of whether or not control unit 84 has been commanded to operate the motor. Accordingly, unless the crank handle member 60 is mounted on its support bracket 74 in the position shown, spring biased switch actuator 82 will move to a position to cause switch 80 to transmit a suitable signal to control unit 84 to prevent energization of motor drive unit 30.

However, when crank handle 60 is placed in the position shown in FIG. 4 with its hook 64 engaged with bracket 78 such that the tip 64 is suitably nested on the bracket the switch actuator member 82 is forced to a position so as to place switch 80 in a condition whereby the controller or control unit 84 will allow electrical power to be transmitted to the motor drive unit 30 in response to operation of other control devices, such as push button switches mounted adjacent the door, not shown, or a remote control unit, such as a radio transmitter, also not shown.

Figure 5:
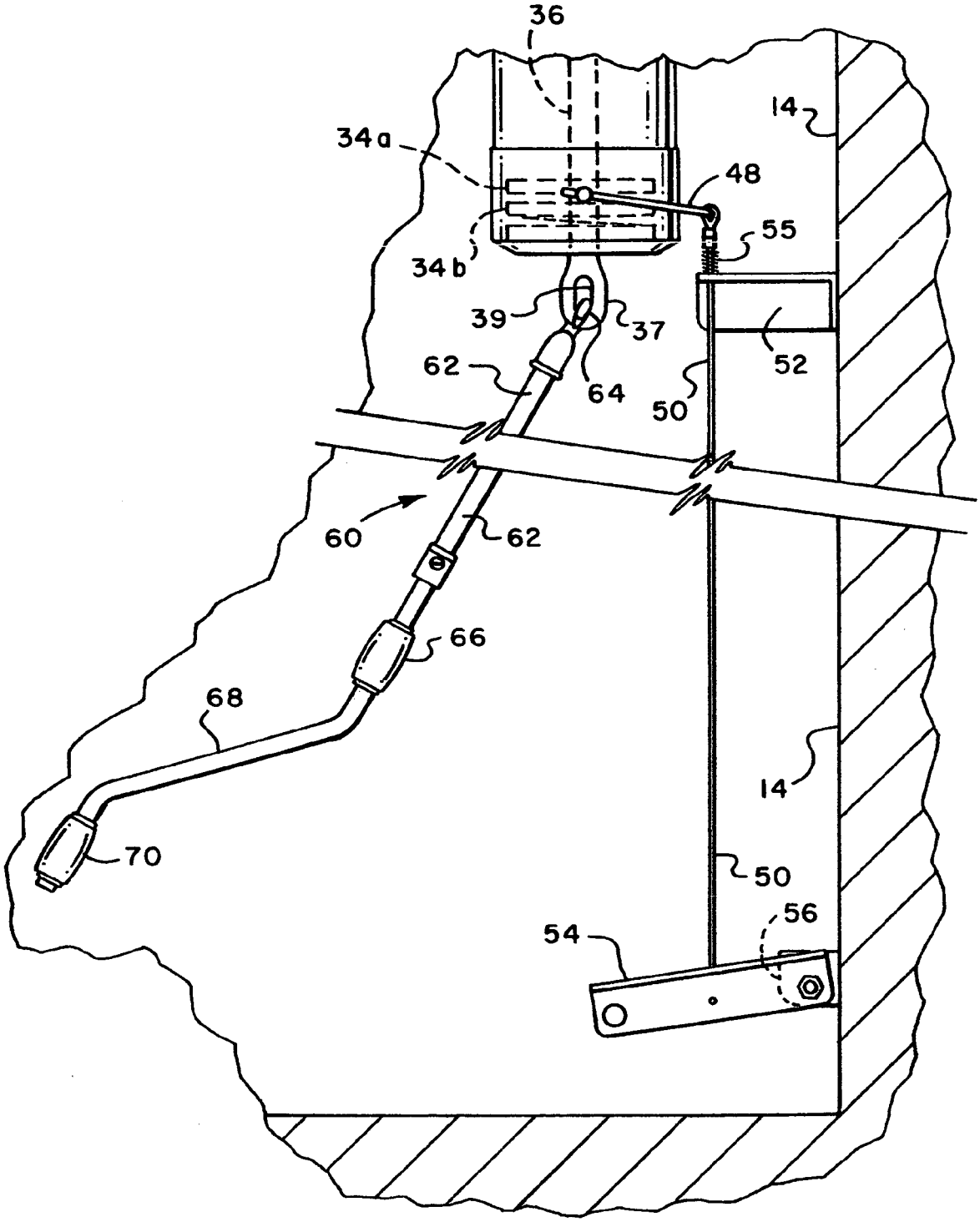
FIG. 5 is a detail view showing the motor brake in a release condition and the manual crank handle attached to the motor shaft drive tang.

Operation of the manual operating mechanism described hereinbefore and shown in the accompanying drawings is believed to be within the purview of one of ordinary skill in the art based on the foregoing description. However, for the sake of clarity, briefly, the door curtain 16 may be rolled onto or off of drum 18 in the event of inability to supply electrical power to motor drive unit 30 by removing the crank handle member 60 from its support bracket 74 and placing the hook 64 in engagement with the drive tang 37, as shown in FIG. 5. A suitable protective cover, not shown, may be normally sleeved over the drive tang 37 and this cover could, of course, be removed, using the hook 64 before engaging the hook with the drive tang by placing the hook through the opening 39. Of course, once the hook 64 has moved out of engagement with the switch actuator member 82, the switch 80 operates to cause the control unit 84 to prevent transmission of electrical power to the motor 32 regardless of any other commands which may be given to the control unit. With the crank handle member 60 engaged with the motor shaft 36 by way of the drive tang 37, the foot pedal 54 may be depressed to disengage brake 34 thereby allowing rotation of shaft 36 by grasping and rotating the crank handle 60 in a manner believed to be understandable from the description and drawings hereof. The motor shaft 36 may, of course, be rotated in either direction, depending upon which direction of movement is desired for the curtain 16.

Once the door curtain 16 has been placed in a desired position with respect to the opening 12, the foot pedal 54 may be released to allow the brake 34 to reengage and the crank handle 60 removed from the drive tang 37 and replaced on its support bracket 74 in the position shown in FIG. 4. In this position, the actuator member 82 of switch 80 is biased to a position such that the switch no longer transmits the signal which is commensurate with preventing electrical power from being transmitted to the drive unit 30. Of course, the motor drive unit 30 remains disabled until the crank handle 60 is replaced to the position shown in FIG. 4 thereby minimizing unwanted operation of the door 10.

Conventional engineering materials and practices may be used in practicing the present invention. Although a preferred embodiment is disclosed in detail herein, those skilled in the art will recognize that various substitutions and modifications may be made without departing from the scope and spirit of the appended claims.

What is claimed is:

1. In an upward acting door including a motor drive unit operably connected to said door for moving said door between open and closed positions, a drive shaft associated with said motor drive unit including a drive tang connected thereto, a manual crank member including a part adapted to be releasably connected to said drive tang for manually rotating said drive shaft, a control unit operably connected to said motor drive unit for supplying electrical power thereto, a support for said manual crank member, switching means mounted in a position in relation to said support such that when said manual crank member is disposed on said support said switch means is operably engaged with said manual crank member in a first condition and when said manual crank member is removed from said support said switch means is in a second condition, said switch means being operably connected to said control unit in a way such that in said second condition of said switch means said control unit is operable to prevent energizing said motor.

2. The door set forth in claim 1 wherein:

said motor drive unit is mounted on a support whereby said drive shaft extends vertically downwardly and said drive tang is mounted on a lower distal end of said drive shaft for engagement by said manual crank member.

3. The door set forth in claim 2 wherein:

said drive tang includes an eye opening formed therein and said manual crank member includes a hook for engagement with said drive tang at said eye opening for rotating said drive shaft with said manual crank member.

4. The door set forth in claim 1 wherein:

said switch means includes a spring biased actuator member engageable with a portion of said manual crank member when said manual crank member is mounted in said support, said actuator member being moveable to change the condition of said switch means in response to removal of said manual crank member from said support.

5. In a flexible curtain rollup door, spaced apart door support brackets for supporting a curtain drum for rolling said curtain onto and off said drum to move said door between an open and closed position;

a right angle electric gear motor drive unit mounted on one of said door support brackets and driveably connected to said drum for rotating said drum in opposite directions, said motor drive unit including an electric motor having a drive shaft, said drive shaft including a drive tang extending from one end of said electric motor;

a crank member adapted for engagement with said drive tang for rotating said drive shaft manually; and a crank support bracket for said crank member including switch means thereon operable to sense when said crank member is mounted on said crank support bracket and when said crank member has been removed from said crank support bracket, said switch means being operably connected to a controller for said motor drive unit to prevent transmission of electrical power to said electric motor when said crank member is removed from said crank support bracket.

6. The door set forth in claim 5 wherein:

said motor drive unit includes an electromechanical brake responsive to electrical power applied to said electric motor to release said drive shaft for rotation and responsive to shutoff of electrical power to said electric motor to engage to prevent rotation of said drive shaft; and a manually actuatable brake release mechanism for releasing said brake to allow rotation of said drive shaft by said crank member.

7. The door set forth in claim 6 wherein:

said brake release mechanism includes a release member on said motor drive unit and operable to disengage said brake in response to actuation thereof, an elongated cable connected at one end to said release member and at an opposite end to a foot pedal for actuation to release said brake when said crank member is connected to said drive shaft for rotation thereof.

8. A method for one of manually opening and closing an upward acting door, said door including an electric motor drive unit drivably connected to said door for moving said door in opposite directions, said drive unit including an electric motor and a drive shaft, said drive shaft including a drive tang extending from one end, said drive unit including a releasable brake operable in an engaged position to prevent rotation of said drive shaft;

a crank member adapted for engagement with said drive tang for rotating said drive shaft manually;

a support bracket for said crank member and switch means operable to sense when said crank member is mounted on said bracket and when said crank member has been removed from said bracket, said switch means being operably connected to a control for said drive unit to prevent transmission of electrical power to said motor when said crank member is removed from said bracket;

said method including the steps of:

removing said crank member from said bracket and connecting said crank member to said drive tang;

releasing said brake; and rotating said crank member and said drive shaft to move said door between open and closed positions.

9. The method set forth in claim 8 wherein:

said brake is electromechanical and responsive to electrical power applied to said motor to release said drive shaft for rotation and responsive to shutoff of electrical power to said motor to engage to prevent rotation of said drive shaft and said door includes a manually actuatable brake release mechanism for releasing said brake to allow rotation of said drive shaft by said hand crank; and said method includes the step of manually operating said brake release mechanism to release said brake while operating said crank member to move said door.

10. The method set forth in claim 9 wherein:

said brake release mechanism includes a pedal and said method includes the step of actuating said pedal to release said brake by placing a foot on said pedal.

11. In an upward acting door including a motor drive unit operably connected to said door for moving said door between open and closed positions, a drive shaft associated with said motor drive unit including a drive tang connected thereto, a manual crank member including a part adapted to be releasably connected to said drive tang for manually rotating said drive shaft, a control unit operably connected to said motor drive unit for supplying electrical power thereto, a support for said manual crank member, switch means mounted in a position such that when said manual crank member is disposed on said support said switch means is in a first condition and when said manual crank member is removed from said support said switch means is in a second condition, said switch means being operably connected to said control unit in a way such that in said second condition of said switch means said control unit is operable to prevent energizing said motor, said motor drive unit includes a brake for preventing rotation of said drive shaft in an engaged position of said brake, a manually actuatable brake release member being associated with said brake for causing disengagement of said brake in response to movement of said brake release member, and said brake release member being manually actuatable to release said brake during operation of said manual crank member to rotate said drive shaft.

12. The door set forth in claim 11 wherein:

said brake release member is connected to an elongated cable depending from said motor drive unit, said cable being connected to a foot actuatable pedal disposed adjacent said door and operable to be actuated to effect disengagement of said brake.

13. The door set forth in claim 12 including:

biasing means for biasing said brake release member to a brake engaged position.

* * * * *